US006039316A

United States Patent [19]

Jackson et al.

[11] Patent Number: 6,039,316

[45] Date of Patent: Mar. 21, 2000

[54] MULTI-HIERARCHICAL CONTROL SYSTEM FOR CONTROLLING OBJECT MOTION WITH SMART MATTER

[75] Inventors: Warren B. Jackson, San Francisco; Tad H. Hogg, Mountain View, both of Calif.

[73] Assignee: Xerox Corporation, Stamford, Conn.

[21] Appl. No.: 09/033,792

[22] Filed: Mar. 2, 1998

[51] Int. Cl.[7] ..... B65H 29/24; G01K 15/00

[52] U.S. Cl. ..... 271/194; 271/195; 364/557

[58] Field of Search ..... 364/557; 271/194, 271/195, 227; 406/19, 88, 89, 90, 91

[56] References Cited

U.S. PATENT DOCUMENTS

| | | | |
|---|---|---|---|
| 4,618,292 | 10/1986 | Judgd et al. | 406/19 |
| 4,828,434 | 5/1989 | Fairman et al. | 406/88 |
| 4,874,273 | 10/1989 | Tokisue et al. | 406/88 |
| 5,634,636 | 6/1997 | Jackson et al. | 271/225 |
| 5,682,331 | 10/1997 | Berlin | 364/557 |
| 5,691,921 | 11/1997 | Berlin | 364/557 |
| 5,803,448 | 9/1998 | Stiel et al. | 271/195 |
| 5,913,268 | 6/1999 | Jackson et al. | 101/420 |
| 5,921,544 | 6/1999 | Benedict | 271/226 |
| 5,927,203 | 7/1999 | Gieser et al. | 101/419 |

OTHER PUBLICATIONS

Kenneth Chou, Gary Guthart, and David Flamm, "A Multiscale Approach to the Control of Smart Materials," Proc. SPIE Symposium on Smart Structures and Materials, Feb. 1995.

Steven R. Hall, Edward F. Crawley, Jonathan P. How, and Benjamin Ward, "Hierarchic Control Architecture for Intelligent Structures," Control Architecture For Intelligent Structures, vol. 14, No. 3, pp. 503–512, May–Jun. 1991.

Tad Hogg and Bernardo A. Huberman, "*Controlling Smart Matter*," Los Alamos preprint available on the Web at http://xxx.lanl.gov/abs/cond–mat/9611024, Nov. 4, 1996.

*Primary Examiner*—William E. Terrell
*Assistant Examiner*—Kenneth Bower

[57] ABSTRACT

Embedded in a transport assembly are arrays of microelectromechanical devices for detecting and making adjustments for perceived changes in their environment. The arrays of sensors and actuators are tightly coupled to each other so that coordinated action of neighboring actuators minimizes the cumulative effort required to move the object. The sensors and actuators are controlled using a multi-hierarchical organization of computational elements. Each computational element in lower levels of the multi-hierarchy communicates with one or more higher level computational elements to define zones of control. An object moving along the transport assembly lies principally in the domain of at least one zone of control. As an object moves along the transport assembly, dominant control over the object moves along the transport with the object. Because the zones of control overlap, dominant control over an object smoothly transitions between groups of computational elements thereby minimizing discontinuities at control boundaries.

20 Claims, 8 Drawing Sheets

MULTI-HIERARCHICAL CONTROL SYSTEM FOR CONTROLLING OBJECT MOTION WITH SMART MATTER

CROSS-REFERENCE TO RELATED APPLICATIONS

Cross-reference is made to the following U.S. Patent Applications, each of which is assigned to the same assignee as the present invention and hereby incorporated by reference: Ser. No. 09/033,221, entitled "Market-Based Control System For Controlling Object Motion With Smart Matter"; Ser. No. 09/033,389, entitled "Adaptive Multiagent Control System For Controlling Object Motion With Smart Matter"; and Ser. No. 09/033,222, entitled "Distributed Control System With Global Constraints For Controlling Object Motion With Smart Matter".

BACKGROUND OF THE INVENTION

1. Field of the Invention

The present invention relates generally to a method and apparatus for controlling microelectromechanical systems (MEMS), and more particularly, to a multi-hierarchical control system for controlling the movement of object on a transport assembly.

2. Description of Related Art

Smart matter is defined herein as a physical system or material with arrays of microelectromechanical devices embedded therein for detecting and adjusting to changes in their environment. For example, smart matter can be used to move sheets of paper in a printing machine or maneuver an aircraft by performing tiny adjustments to wing surfaces. Generally, each microelectromechanical device embedded in smart matter contains microscopic sensors, actuators, and computational elements. A characteristic of smart matter is that the physical system consists of large numbers (possibly thousands) of microelectromechanical devices. These devices work together to deliver a desired higher level function (e.g., moving a piece of paper from one location to another, or flying a plane).

Programs for controlling smart matter do not always adequately achieve the desired higher level function of issuing command to compensate for detected changes in a physical system because of the significant number of devices that operate in parallel to control it. That is, there exists a number of factors which make the computational task of a control program for smart matter difficult. One factor which may be cause control programs to be computationally intense is caused by the high redundancy of sensors and actuators in the physical material. In order for smart matter systems to exhibit the enhanced reliability and robustness over conventional systems, smart matter systems contain many more devices than necessary to achieve a desired performance. Failure or improper function of some elements, even a significant fraction, is compensated by the actions of the redundant components. Moreover, the ability of smart matter systems to tolerate component failure can be used beneficially to lower the fabrication cost of the components.

One approach for controlling smart matter is to rely on a single global processor coupled with rapid access to the full state of the system and detailed knowledge of system behavior. This method, however, is generally ineffective because of the large number of devices embedded in smart matter. Another approach for controlling smart matter is through the use of a collection of autonomous computational elements (or agents) that use sensor information to determine appropriate actuator forces. Using multiple computational elements to provide distributed control instead of centralized control may prove more effective because each computational element is only concerned with limited aspects of the overall control problem. In some multi-agent systems, individual agents are associated with a specific sensor or actuator embedded in the physical system. This method for controlling smart matter defines a community of computational elements that, in their interactions, strategies, and competition for resources, resembles natural ecosystems. Furthermore, by distributing control among computational agents, the system as a whole is better able to adapt to environmental changes or disturbances because the system can compensate for new circumstances by simply changing the relationship of the agents.

Although multi-agent systems have been used to solve distributed control problems, they have been limited to systems which are physically large or geographically scattered. For example, multi-agent systems have been used in distributed traffic control, flexible manufacturing, robotic system design, and self-assembly structures. Using multi-agent systems to control smart matter is different from these known multi-agent systems because of the tight coupling between computational elements and their embedded physical space. Furthermore, controlling smart matter using traditional multi-agent systems is difficult because of mechanical interactions that decrease in strength with the physical distance between them. This makes the computational problem difficult because interactions between computational elements cannot be ignored.

Hierarchical control has also been used to solve distributed control problems. These previous approaches have suffered from the problem of smooth transfer of control from one region to another. The control transfer problem greatly complicates the control problem for each computational element and leads to less robust and adaptable systems because not only does the local control have to adapt but also the transfer algorithm must also adjust. There exists, therefore, a need to provide a system for controlling smart matter that solves these as well as other control problems. It would, therefore, be desirable to provide a distributed control system for smart matter that is able to adapt to physical systems which have differing specifications because of exceeding manufacturing tolerances or because of material defects. In addition, it would be desirable to provide a controller for smart matter that robustly coordinates a physically distributed real-time response with many devices in the face of failures, delays, changing environmental conditions, and incomplete models of system behavior.

SUMMARY OF THE INVENTION

In accordance with the invention there is provided a transport assembly, and method therefore, for moving an object. Sensor units are arranged on the transport assembly to provide positional information of the object. Actuator units are arranged on the transport assembly for moving the object relative to the transport assembly. Computational elements are arranged multi-hierarchically into groups for controlling motion of the object along the transport assembly. The groups of computational elements are coupled to selected ones of said sensor units and said actuator units to define zones of control. Each zone of control overlaps with other zones of control to coordinate transition of control between the computational elements as the object moves along the transport assembly

BRIEF DESCRIPTION OF THE DRAWINGS

These and other aspects of the invention will become apparent from the following description read in conjunction with the accompanying drawings wherein the same reference numerals have been applied to like parts and in which.

DETAILED DESCRIPTION

A. Transport Assembly

Figure 1:
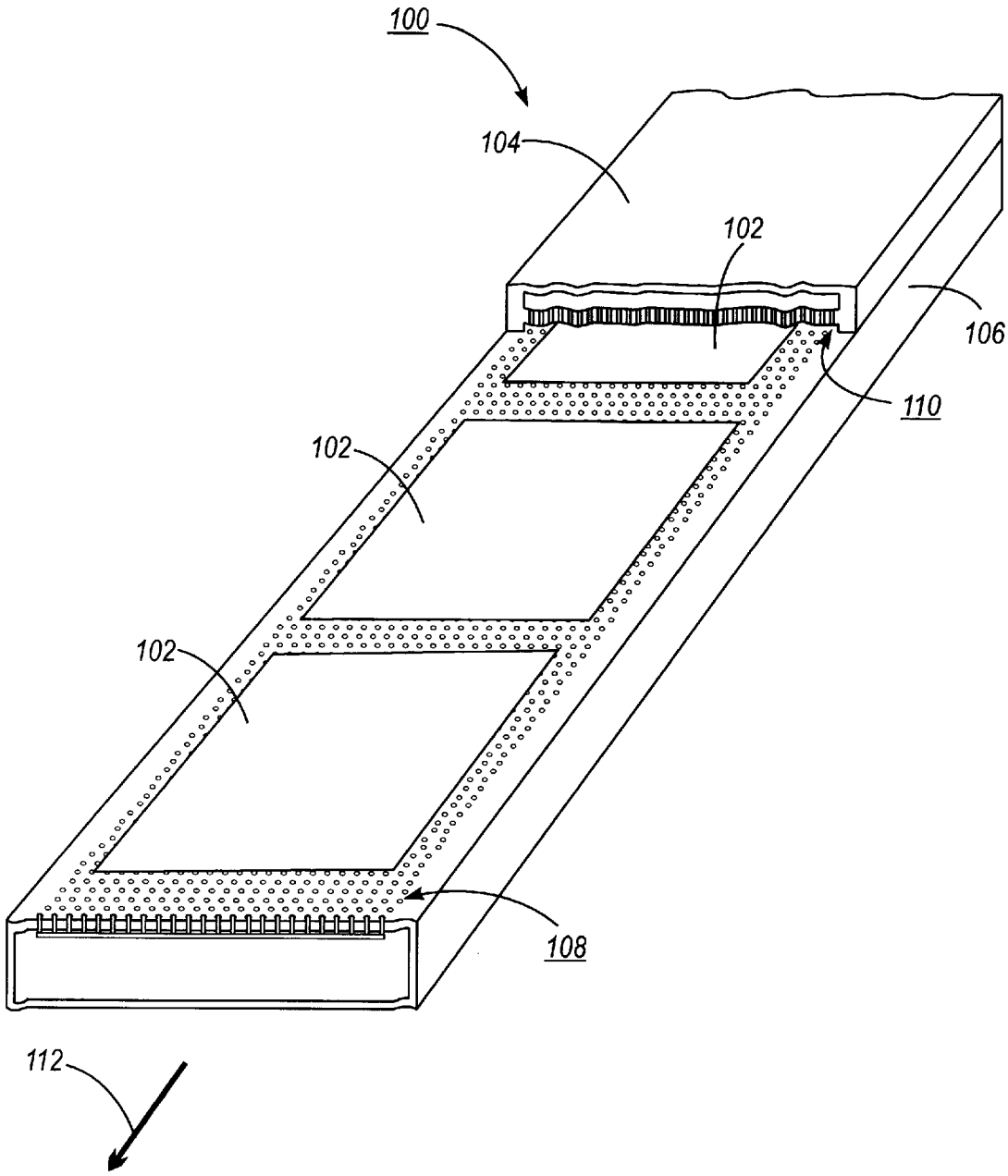
FIG. 1 illustrates a smart matter transport assembly for carrying out the present invention.

Referring now to the drawings where the showings are for the purpose of describing the invention and not for limiting same, FIG. 1 illustrates a transport assembly 100. The transport assembly 100, which is used to transport objects 102 in the process direction 112, is divided up into an upper section 104 and a lower section 106. For illustrative purposes part of the upper section 104 is cut away. Advantageously, the transport assembly 100 can transport a number of different types of materials such as paper, plastics, glass, foils, fabrics, uncured rubber and wafers. The sections 104 and 106 are sufficiently spaced apart to define a spacing 110 in which the object can travel along the transport assembly without contacting either the upper or lower sections 104 and 106. Embedded in both the upper and lower sections 104 and 106 are arrays of spatially fixed microelectromechanical devices 108 (MEMS) that dynamically support, move, and guide the objects 102 through the transport assembly 100. It will be understood by those skilled in the art that depending on the size, weight and flexibility of the object being transported and the speed and accuracy in which the object is required to be transported, the transport assembly may consist of only one of the upper section 104 or the lower section 106.

Figure 2:
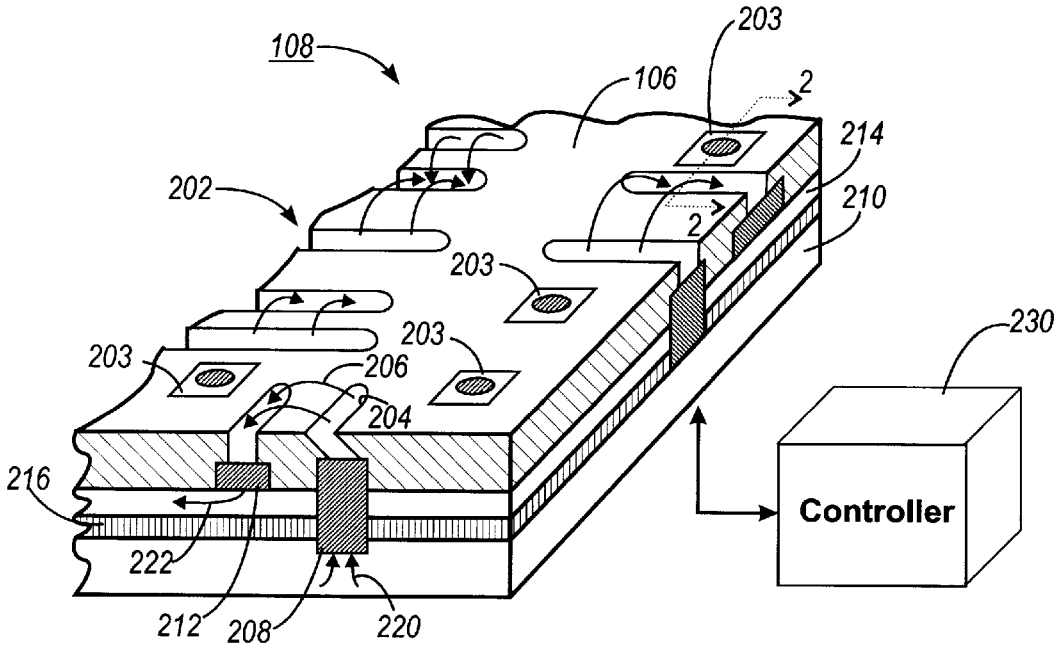
FIG. 2 illustrates a portion of the lower section of the transport assembly shown in FIG. 1.

FIG. 2 illustrates a portion of the lower section 106 of the transport assembly 100 shown in FIG. 1. More specifically, FIG. 2 illustrates a number of microelectromechanical devices 108 that consist of combinations of actuators 202, sensors 203, and controller(s) 230. In one embodiment, the actuators, sensors, and controller are fabricated together on a single silicon wafer. In another embodiment shown in FIG. 2, the sensors and actuators are fabricated in a housing separate from the controller 230. In the embodiment shown in FIG. 2, the actuators 202 are air jet actuators that include two or more channels 204. In another embodiment not shown the actuators 202 engage a mechanical drive coupled to rollers for transporting flexible objects such as paper.

More specifically in FIG. 2, the arrows indicated by reference number 206 illustrate the general movement of air exiting and entering the air jet channels 204. At least one of the channels of an air jet allows the exit of flowing air and the other of the channels the entrance of flowing air. It will be appreciated by those skilled in the art, however, that the air jet actuators may consist of a single channel which allows only the exit of air. A low-pressure plenum 214 is separated from high-pressure plenum 210 by a partition 216. The difference in pressure between low-pressure plenum 214 and high-pressure plenum 210 permits air to flow from one channel to another. For example, a valve 208 can be selectively operated to permit high-pressure air in plenum 210 to flow upward at an angle as indicated by arrows 220, to impart momentum to objects 102 on the transport assembly, and pass downward through valve 212 into plenum 214 as indicated by arrows 222.

Figure 3:
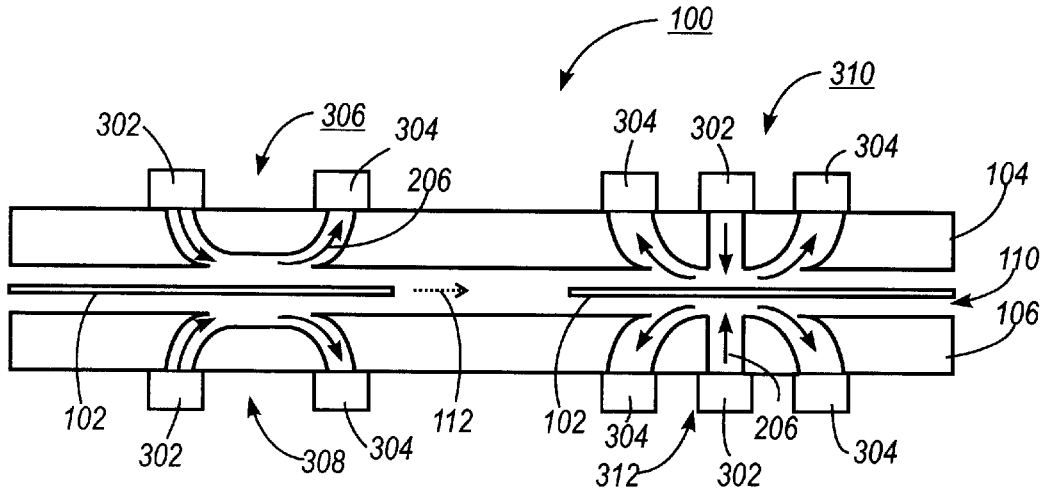
FIG. 3 illustrates two different types of air jet actuators that are embedded in the transport assembly shown in FIG. 1.

FIG. 3 illustrates examples of two different types of air jet actuators 202 that are embedded in transport assembly shown in FIG. 1. As set forth above, the transport assembly 100 is divided into upper and lower sections 104 and 106 with the spacing or passageway 110 therebetween. A first type of air jet is indicated by reference numbers 306 and 308 and a second type of air jet by reference numbers 310 and 312. The two types of air jet actuators have valves 302 for releasing air from high-pressure plenum 212 and valves 304 receiving air into low-pressure plenum 214. The flow of air in FIG. 3 is indicated generally by arrows 206. Depending on the direction in which the air jet actuators 306 and 308 are positioned, air released therefrom will urge the object 102 in a selected process direction 112 and speed by adjusting the amount of air released onto either side of the object 102. In contrast, the air jet actuators 310 and 312 can be used to support the object 102 by applying an opposing vertically directed air flow as indicted by arrows from valves 302.

It will be appreciated by those skilled in the art that the first type of air jet actuators 306 and 308 may be positioned so that they exert a force opposite to that shown in the Figures in order to impart momentum to stop the object from moving in the process direction 112. In addition, it will be appreciated by those skilled in the art that two sets of the first type of air jet actuators 306 and 308 may be oriented to apply forces to rotate the object. For example, the object may be rotated by having a first set of air jet actuator, located on one side of the object, push in the process direction, while having a second set of air jet actuator, located on the other side of the object, push in a direction opposite to the process direction so that the combined effect of the two air jet actuators is to apply a torque to the object.

Figure 4:
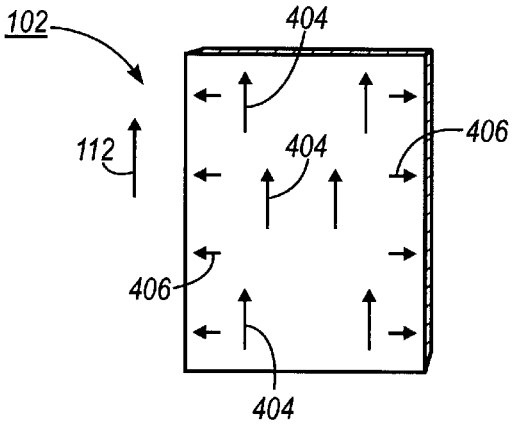
FIG. 4 illustrates one manner in which directional forces from air jet actuators are applied to the object to control its movement along the transport assembly.

FIG. 4 illustrates one manner in which directional forces from air jet actuators 202 are applied to the object 102 to control its movement along transport assembly 100 in the process direction 112. Longitudinal forces, indicated by arrows 404, are applied to cause the object to move in the process direction 112. Lateral forces, indicated by arrows 406, are applied perpendicular to the direction of motion to stabilize the object 102. Vertical forces, not shown, help maintain the object 102 between the upper and lower sections 104 and 106 of the transport assembly 100. In FIG. 4, the relative strength of the forces 404 and 406 applied to the object 102 are illustrated by the length of the arrows 404 and 406. It will be appreciated by those skilled in the art that the accelerations resulting from these vertical, lateral, and longitudinal forces applied to an object will vary depending on the type of material and size of the object. Thus, for example, paper which is lighter and more flexible than glass may require smaller longitudinal forces but greater lateral forces to stabilize it on transport assembly 100 than a more rigid object such as glass.

Figure 5:
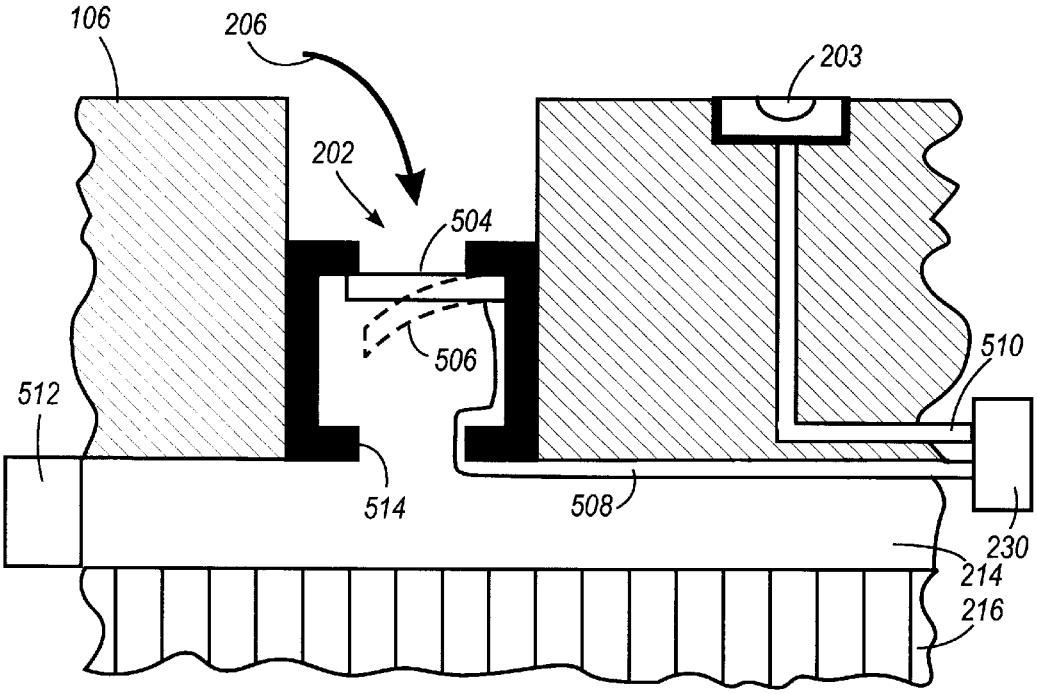
FIG. 5 illustrates a side view of an air jet, a sensor, and a controller as seen along view line 2—2 in FIG. 2.

FIG. 5 illustrates a side view of an air jet 202, sensor 203, and controller 230 as seen along view line 2—2 in FIG. 2. In the embodiment shown in FIG. 5, the air jet 202 is a piezoelectric flap valve. The flap valve is electrically controlled through lead 508 by controller 230 to be either in a closed position, indicated by reference number 504 (solid lines), or an open position, indicated by reference number 506 (dotted lines). The air jet 202 includes a housing 514 positioned in an aperture of the surface of lower section 106. In FIG. 5 the air moves inward because it is coupled to low-pressure plenum 214 as indicated by arrow 206. The pressure in the plenum is maintained by air pressure source 512. Sensor information from sensor 203 is received through lead 510 by controller 230. The sensor 203 in one embodiment is an optical sensor that is sufficiently accurate and quick to detect the object 102. In other embodiments, the sensor 203 is another type of contactless sensor such as a pressure sensor, acoustic sensor, or electrostatic sensor.

B. Multi-hierarchical Control Organization of the Transport Assembly

Figure 6:
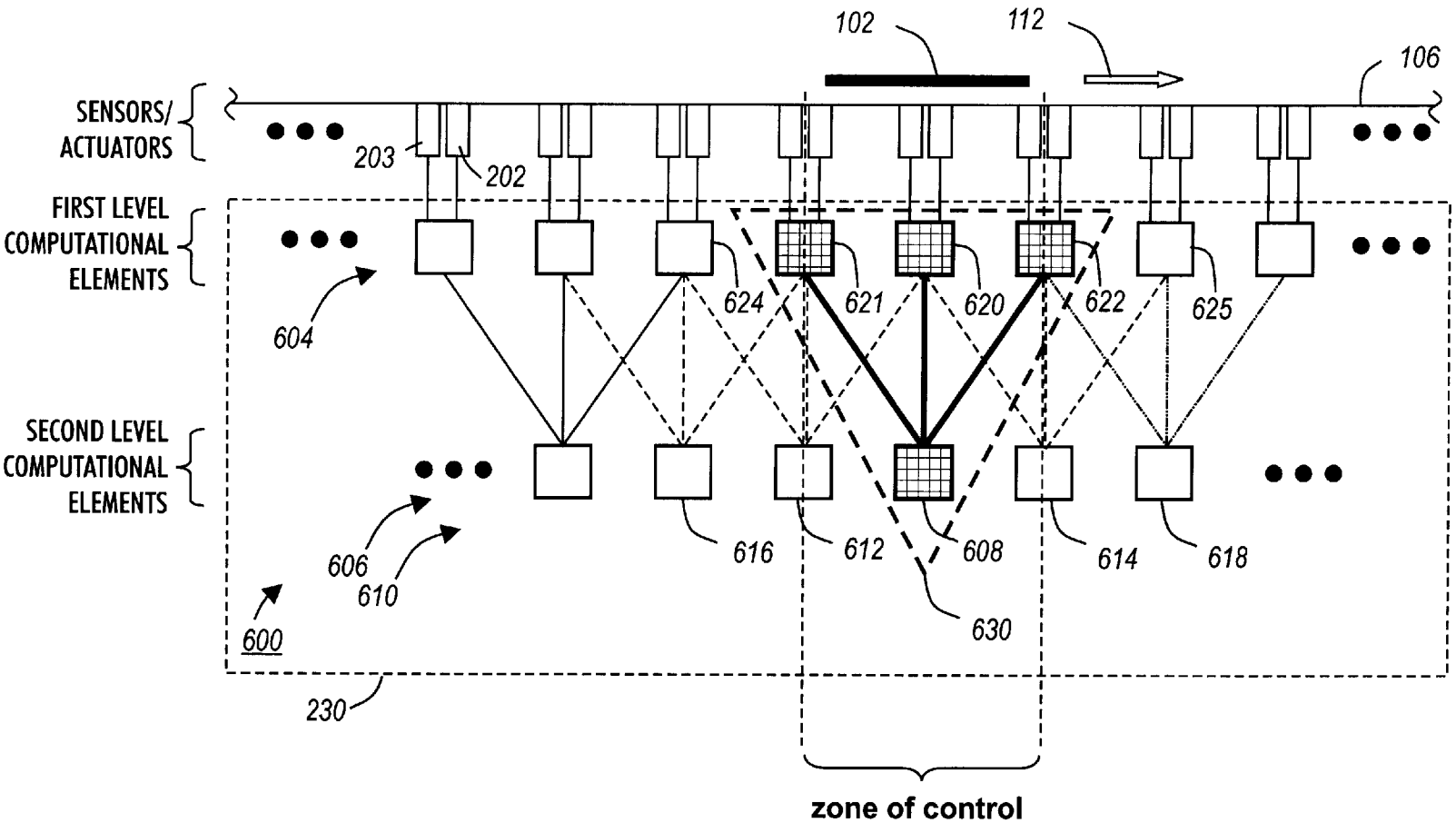
FIG. 6 illustrates the controller shown in FIG. 2 with a multi-hierarchical organization of computational elements for controlling the sensors and actuators embedded in the transport assembly.

FIG. 6 illustrates the controller 230 shown in FIG. 2 in which groups of computational elements are formed using a multi-hierarchical organization of computational elements 600. Using the embedded sensors 203 and actuators 202, the controller 230 actively controls the movement of objects such as paper traveling between the upper and lower sections of the transport assembly. In accordance with the invention, control of sensor 203 and actuators 202 embedded in the transport assembly 102 is distributed among overlapping groups of computational elements 600 in the controller 230. The overlapping groups of computational elements define overlapping zones of control. Each group of computational elements is concerned with a limited portion of the entire control problem. Advantageously, distributing control among groups of computational elements 600 permits each group to independently compute the state of an object on the transport assembly that is within its zone of control.

Each computational element 600 (illustrated in the Figures with squares) maps to a region of the transport assembly, which includes one or more sensors and actuators. In operation, these computational elements respond to environmental changes that sensors and actuators detect within a time interval on the order of 1–100 milliseconds. In the case of the transport assembly 100 shown in FIG. 1, sensors 203 and air jet actuators 202 quickly ascertain the amount of force to apply to each object or paper 102 on the transport assembly within the time interval to precisely move the object. Different groups of computational elements distribute control to provide real time responses to local environmental changes detected along the transport assembly. During each time interval, groups of computational elements operate to stabilize and propel one or more objects along the transport assembly. Only one of the groups of computational elements has dominant control over any one object during each time interval. Consequently, dominant control over an object shifts between groups of computational elements with overlapping zones of control as the object moves along the transport assembly.

Unlike other distributed control organizations, there exists a high density of sensors and actuators embedded in the transport assembly. In one embodiment, the lower section of transport assembly 106 has on the order of 0.1–4 sensors and/or actuators per square centimeter. In addition, unlike other distributed control systems, the actuators are positioned sufficiently proximate to each other that their output may be cross-coupled. For example, output from two neighboring air jet actuators may cumulatively apply a force that is different than the sum of the forces applied independently. To account for these interaction effects, the groups of computational elements are hierarchically organized into multiple levels of computational elements or processes to minimize actuation effort required by each individual actuator and the error in achieving a desired system goal. The domain of control for each grouping of computational elements does not extend beyond some localized region of control. By distributing control among groupings of computational elements that map to spatially localized groupings of sensors and actuators, response to local changes can be made even in the presence of communication delays and corrupted information. Furthermore, having a distributed control organization permits scaling without resulting in significant decreases in response time of system elements.

More specifically, FIG. 6 illustrates a block diagram of a cross section of the lower section 106 of the transport assembly. Embedded at the surface of the lower section 106 are multiple sensors 202 and actuators 203. The sensors 203 transmit positional information of the object 102 to the controller 230, while the actuators or air jet actuators 202 receive commands from the controller 230 to apply directional forces in the form of air to the object 102. The computational elements 600 are coupled to ones of the sensors and actuators to receive and transmit information therefrom. FIG. 6 shows a first level of computational elements 604 that are each coupled to one sensor 203 and one actuator 202. It will be appreciated, however, by those skilled in the art that an actuator such as an air jet may include one or more channels of exiting or entering air and that a sensor may have one or more sensor elements. It will also be appreciated by those skilled in the art that the controller 230 can be used to control other types of pneumatic actuators such as vacuum actuators. In addition, it will be appreciated that the controller can be used to control mechanical actuators. For example, controller 230 can be used to control mechanical rollers or a vacuum belt to move sheets of paper in an electronic printing machine.

It will also be appreciated that each first level computational element 604 may be coupled to a set of one or more sensors or actuators. Furthermore, it will be appreciated that the sensors and actuators could be coupled directly or indirectly to computational elements at any level of the hierarchy of computational elements. In another embodiment, not shown, the computational elements are coupled to sensor units that are physically offset from actuator units on the transport assembly. In this alternate embodiment, the computational elements are coupled to sensor units and actuator units which are no co-located immediately adjacent to each other. Advantageously, in this alternate embodiment computational elements are able to predict the amount of actuation force needed to be applied to an object on the transport assembly as the object moves into the region of control of the computational element.

In the embodiment shown in FIG. 6, each sensor 203 embedded in lower section 106 records a series of discrete measurements that correspond to the instantaneous position of an object on the transport assembly. These discrete measurements are transmitted to a first level computational element 604 coupled thereto. In FIG. 6, each first level computational element 604 receives sensor information from at least one sensor 203. Positional measurements received by a first or lower level computational element 604 is transmitted to higher or second level of computational elements 606. Each computational element in the higher or second level is coupled to at least one lower or first level computational elements to define groups of computational elements. For example, second level computational element 608 is coupled to first level computational elements 620–622 to define a group 630 of computational elements. These groups of computational elements are arranged multi-hierarchically. More specifically, each lower level computational element (i.e., child element) is coupled to two or more upper level computational elements (i.e., parent elements) to define regions or zones of overlapping control. For example, the group of computational elements 608, 620, 621 and 622 has a zone of control that overlaps with the zone of control of the group of computational elements 612, 620, 621 and 624, and the zone of control of the group of computational elements 614, 620, 622 and 625. Some of the sensors and actuators to which these groups of computational elements are coupled to, are identical, as illustrated in FIG. 6.

Information processed by each of the computational elements in the controller 230 is output from one or more of the sensor units 230. As illustrated in FIG. 6, computational elements forming the second level 606 receive sensor data from multiple sensor units, whereas the first level computational elements 604 receive sensor data from a single sensor unit. The sensor data received by each computational element is used to calculate an actuator response that is based upon a desired state and a current state of the object's position and velocity on the transport assembly. Computational results at each level propagate to the lower level of computational elements before being transmitted to an actuator 202 coupled thereto. The computational results specify a desired actuator state. This process repeats each time sensor information is received, thereby creating a feedback loop in which positional information and correctional commands are received and issued approximately every 1–100 milliseconds.

Each group of computational elements is able to make decisions independent of any other group of computational elements. Although a decision from a higher level computational element may overrule a decision from a lower level computational element, each computational element irrespective of its level is able to ascertain how much force should be applied to an object on the transport assembly. In the multi-hierarchical organization shown in FIG. 6, the second level of computational elements is also the highest level of computational elements 610 (or high level computational elements) in the hierarchy. In accordance with the invention, dominant control over an object shifts between high level computational elements 610 with overlapping zones of control as the objects move along the transport assembly. Because of the overlapping multi-hierarchical control organization, transitions of control between high level computational elements is coordinated. Advantageously, by overlapping transition of control between high level computational elements, discontinuities that may exist at control boundaries are minimized.

The set of lower level computational elements 604 to which each high level computational element 610 is coupled defines a zone of control for the high level computational element. For example, the high level computational element indicated by reference number 608 in FIG. 6 is coupled to the three first level computational elements indicated by reference number 620–622. Depending on the configuration of the controller 230, each of the high level computational elements 610 may share control of the object 102 with neighboring high level computational elements. For example, the second level computational element 608 may have 50% control over the object while each of its immediately neighboring high level computational elements may have 25% control over the object. Depending on how control over an object is allocated among high level computational elements, the first level computational elements compute how much force the actuator 202 coupled thereto should apply to the object. In one embodiment, the low-level computational elements tally actuator settings provided by each high level computational element as a fraction of their allocated control.

B.1 Adaptable Control

An aspect of the multi-hierarchical organization of computational elements or processes in the controller 230 is that the multi-hierarchical organization dynamically adapts to accommodate different sized objects. This aspect of the invention insures that the number of levels of computational elements in the multi-hierarchy is optimized for each object being transported. Although the minimum number of levels in any multi-hierarchy is at least two, there exists no maximum number of levels. The number of levels at which the high level of computational elements 610 is defined for any multi-hierarchy is a number of first level computational elements sufficient to span the object. That is, the multilevel hierarchy is dynamically configured to best control any given object by growing or shrinking the number of first level computational elements. This in turn grows or shrinks the size of the multi-hierarchy. In one embodiment, the number of levels in the multi-hierarchy is simply initialized before transporting an object of a known size. For example, in an electronic printing machine, the size of the object, paper, is known before printing a document. In another embodiment, the size of the object is automatically detected by increasing the number of levels until the highest level computational elements communicates with a sufficient number of first level computational elements to detect the edges of the object.

Figure 7:
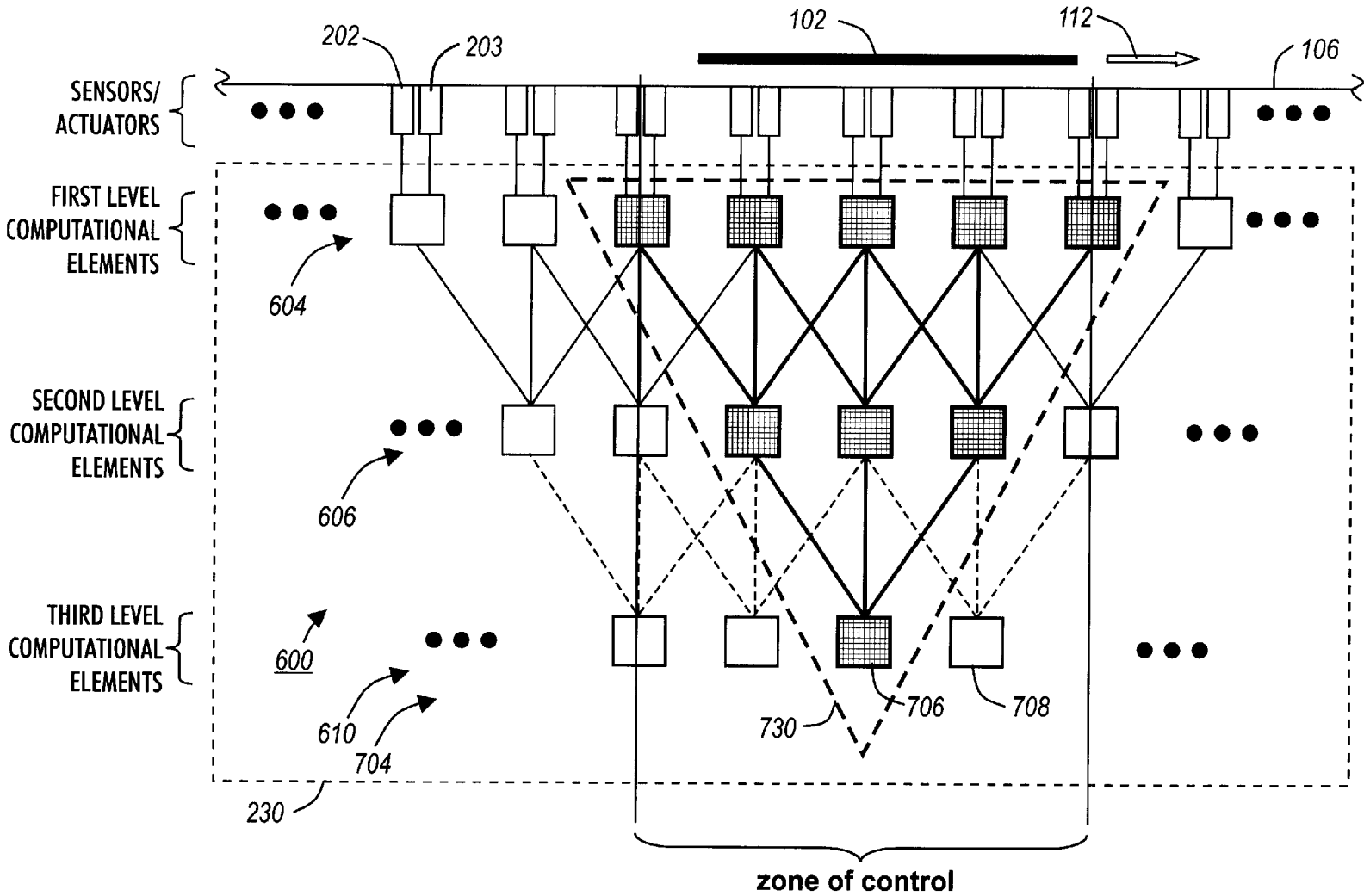
FIG. 7 illustrates a three level multi-hierarchical organization expanded from the two level organization shown in FIG. 6.

This feature of the invention insures that the organization of the multi-hierarchy dynamically configures itself to most effectively control the sensors and actuators of the transport assembly. This yields a multi-hierarchical organization that is computationally efficient since its complexity is minimized. In FIG. 7, the multi-hierarchy expanded one level or a third level of computational elements 704 from the multi-hierarchical organization shown in FIG. 6. The highest level of computational elements 610 shown in FIG. 7 is the third level of computational elements 704. Each third level computational elements is coupled to five first level computational elements 604. For example, the third level computational element 706 forming one of the computational elements in group 730 has an expanded zone of control that includes five first level and three second level computational elements (all identified in the Figure with a checkerboard pattern). As illustrated in FIGS. 6 and 7, the controller 230 defines the number of first level computational elements sufficient to span the object at the highest level of computational elements. Accordingly, the controller 230 adapts the number of levels in the multi-hierarchy to most effectively define regions of overlapping control between multiple high level computational elements.

B.2 Coordinated Overlapping Control

Another feature of the multi-hierarchical organization is the manner in which transitions of dominant control between computational elements at the highest level of 610 take place. Generally, transitions of control between computational elements in a distributed system can affect the motion of the object if they are not made gradually so that discontinuities that exist at the boundaries between regions of control are minimized. Absent overlapping control, discontinuities in perceived object motion are likely to occur at junctions between computational elements because the computational elements receive sensor information before having dominant control over an object. In addition, differences in actuator efficacy can lead to undesirable discontinuities in object motion. By creating overlapping zones of control, high level computational elements are better able to coordinate transitions of control as an object moves along the transport assembly from one region of control to another.

At any one instant in time, an object lies principally in the domain of a set of high level computational elements. This set of high level computational elements includes at least one computational element that assumes dominant control over the object. Other high level computational elements may form part of the set but may have limited control depending on the particular manner in which control is allocated in the system. This set of high level computational elements coordinates transfer of information by lower level computational elements to other computational elements forming part of the controller 230. As the object moves along the transport assembly, different high level computational elements assume absolute or dominant control over the object. As a result, the controller minimizes discontinuities at jurisdictional boundaries of the computational elements as the object moves along the transport assembly by overlapping a spatially-fixed zone of control for each computational element.

In one embodiment, transfer of control between computational elements is achieved by allocating a percentage of control of the object between the computational elements. For example, assuming only the high level computational elements 610 have control over the motion of the object shown in FIG. 6, second level computational elements 612, 614, 616, and 618 can assert control over different ones of the actuators 620, 622, and 624 under the control of second level computational element 608. The fraction of control a computational element has over an object is determined by the fraction of overlap between the object and the zone of control. Such a control transfer is linear; alternatives include cubic splines to insure smooth transfer. As a result, smooth or coordinate transitions of control from one computational element to another occur as the object moves along the transport assembly. In another embodiment, transfer of control is accomplished by handoff functions that specify the fraction of control allocated to various high level computational elements as a function of the object position, time, and other relevant variables. This generalizes the preceding embodiment by allowing for arbitrarily complex coordination of control between adjacent zones of control.

B.3 Inhomogeneous Control

Figure 8:
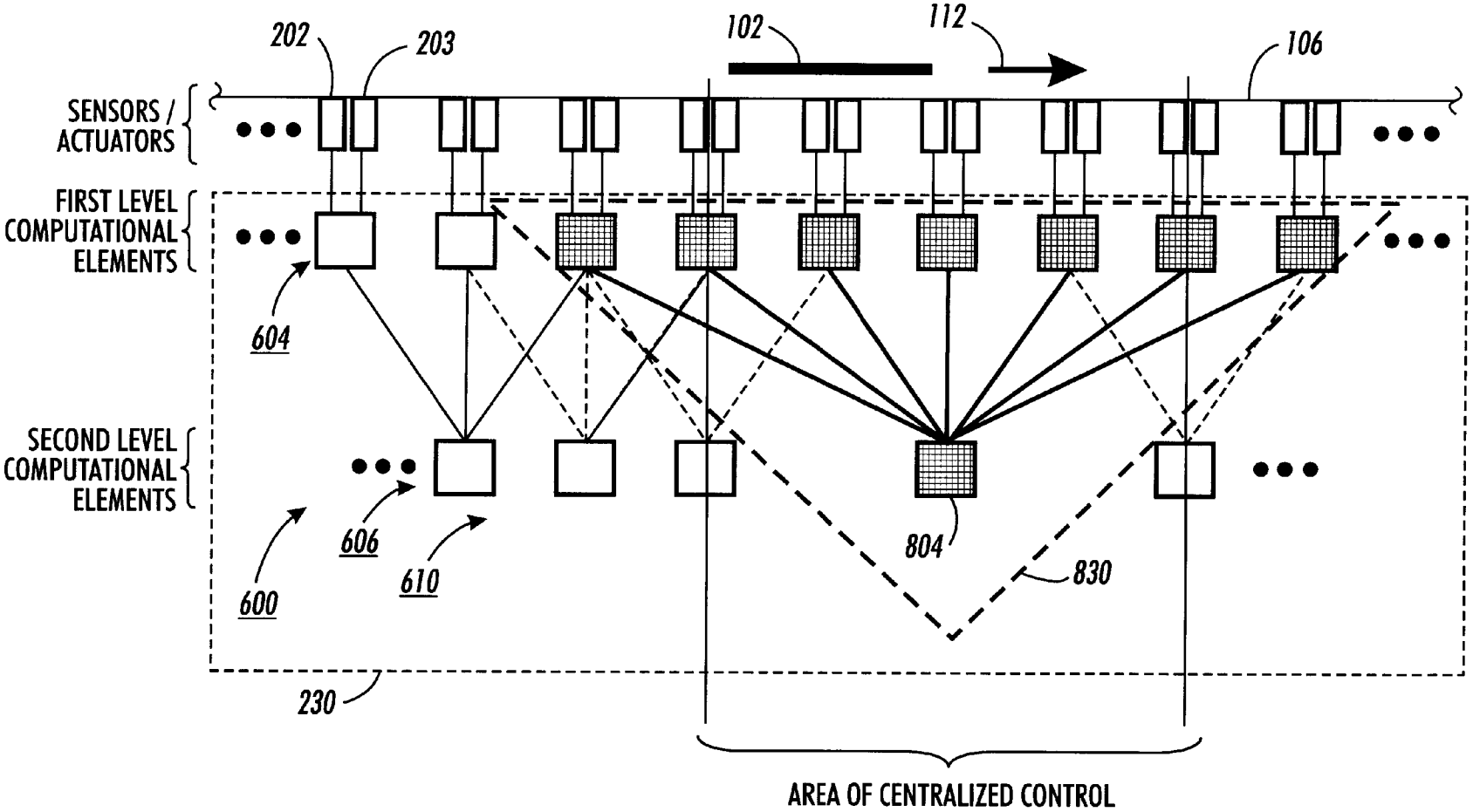
FIG. 8 illustrates an example in which the multi-hierarchical organization of computational elements or processes shown in FIG. 6 is inhomogeneous.

Yet another feature of the invention is that the multi-hierarchical organization of computational elements need not be homogeneous (i.e., identical). FIG. 8 illustrates an example in which the multi-hierarchical organization of computational elements or processes shown in FIG. 6 is inhomogeneous. That is, the organization of control between the second level computational elements 606 varies between high level computational elements. In the example shown in FIG. 8, the second level computational element 804 is coupled to seven first level computational elements 604 to define a group of computational elements 830 (illustrated using a checkerboard pattern). Unlike second level computational element 804, all of the other second level computational elements shown in FIG. 8 are coupled to three first level computational elements 604. This inhomogeneous allocation of control provides more centralized control in selected regions of the transport assembly.

In one embodiment, the transport assembly is used to automatically move and position paper for scanning or printing. When paper is transported in a scanner or printer, certain regions of the paper path require movement that is more precise than in other regions. For example, when paper is required to be registered at a particular location in either the scanning or printing assembly, the area of increased control ensures greater accuracy because the number of transitions between high level computational elements is minimized in those regions. For example, paper is precisely registered when a xerographic image is transferred onto paper or when paper is registered with a platen for scanning. Unlike the homogeneous organization shown in FIG. 6, the inhomogeneous organization of computational elements shown in FIG. 8 provides increased centralized control in identified areas of the transport assembly. Consequently, the degree of hierarchical control in inhomogeneous organizations varies spatially.

B.4 Two Dimensional Motion Control

Figure 9:
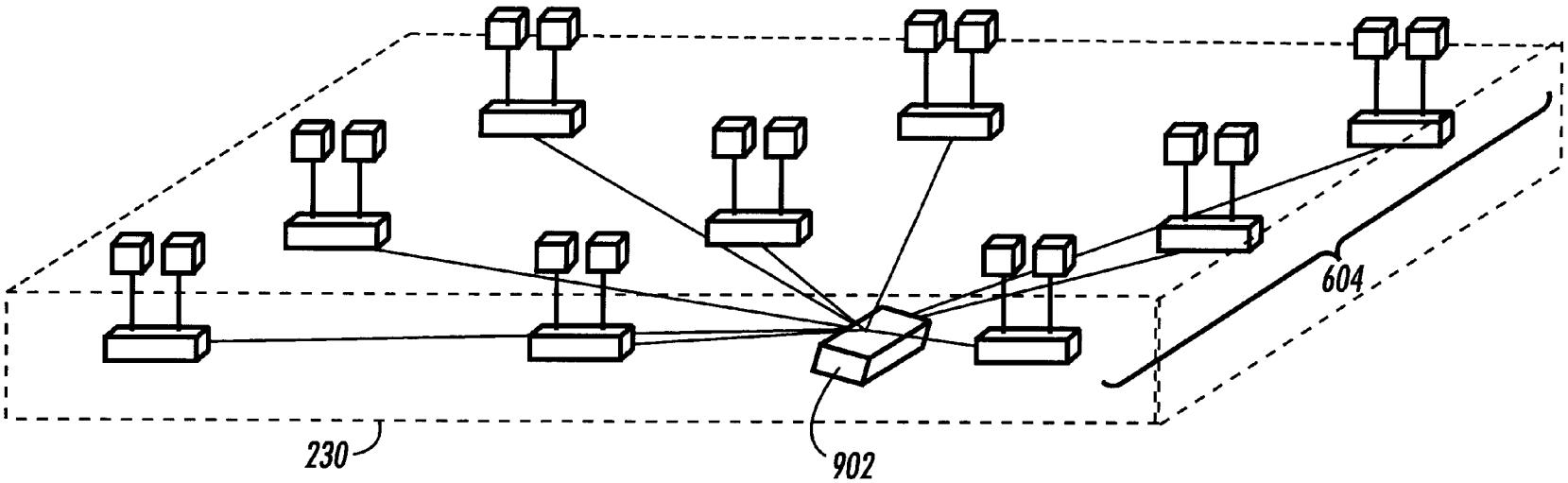
FIG. 9 illustrates an example of a two-dimensional multi-hierarchical control organization.
Figure 10:
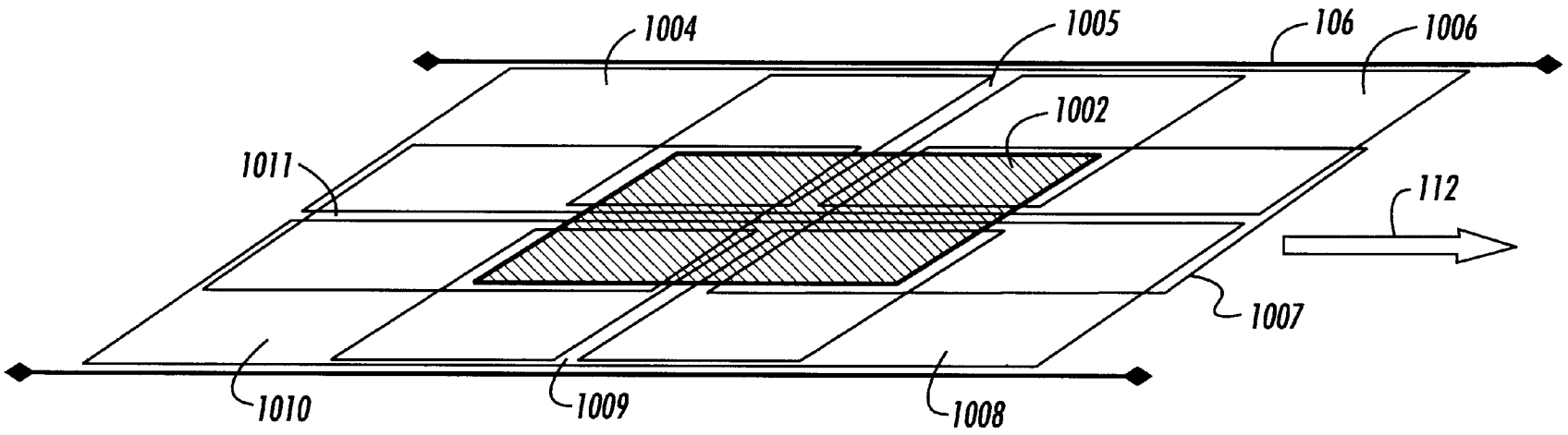
FIG. 10 illustrates the zone of control of a second level computational element illustrated in the two-dimensional multi-hierarchical organization shown in FIG. 9.

FIGS. 9 and 10 illustrate an example of the multi-hierarchical control organization shown in FIG. 6 in two dimensions. More specifically, the first level computational elements 604 extend in two dimensions so that the second level computational elements 606 receive information from a two-dimensional neighborhood of sensors. In the example shown in FIG. 9, second level computational element 902 is coupled to three lower level computational elements in one dimension and three lower level computational elements in a second dimension thereby defining a two dimensional area of control. In FIG. 10, the zone of control of the second level computational element 902 is indicated by reference number 1002. Reference numbers 1004–1011 indicate zones of control of other second level computational elements that overlap the zone of control of second level computational element 902. It will be appreciated by those skilled in the art that FIGS. 9 and 10 illustrate only one manner in which the control elements can be organized to define two-dimensional control areas. In addition, it will be appreciated that the two-dimensional control structure can be both adaptable as shown in FIG. 7 and inhomogeneous as shown in FIG. 8.

C. Summary

The invention has been described with reference to a particular embodiment. Modifications and alterations will occur to others upon reading and understanding this specification taken together with the drawings. The embodiments are but examples, and various alternatives, modifications, variations or improvements may be made by those skilled in the art from this teaching which are intended to be encompassed by the following claims.

It will be appreciated that the controller 230 may be readily implemented in software using software development environments that provide portable source code that can be used on a variety of hardware platforms. Alternatively, the disclosed system may be implemented partially or fully in hardware using standard logic circuits. Whether software or hardware is used to implement the system varies depending on the speed and efficiency requirements of the system and also the particular function and the particular software or hardware systems and the particular microprocessor or microcomputer systems being utilized.

In addition, the controller 230 may either be a physically distributed system in which each computational element is operating on a separate processing unit. Alternatively, the controller may be implemented in a memory of a centralized processing unit having one or more processors. Because each computational element does not have to be cognizant of whether it is operating on a physically distributed or centralized system, the software for implementing the controller can be implemented to run in either environment.

It will be further appreciated by those skilled in the art that actuators 202 can be used to move an object along the transport assembly with fluids other than air. A more detailed description of the sensors and actuators forming a transport assembly is disclosed in U.S. Pat. No. 5,634,636, which is incorporated herein by reference. For additional details, examples and background on smart matter, the following article is incorporated herein by reference: Hogg et al., "Controlling Smart Matter," Los Alamos preprint at http://xxx.lanl.gov/abs/cond-mat/9611024, Nov. 4, 1996.

We claim:

1. A transport assembly for moving an object, comprising:

sensor units arranged on the transport assembly for providing positional information of the object;

actuator units arranged on the transport assembly for moving the object relative to the transport assembly; and computational elements arranged multi-hierarchically into groups for controlling motion of the object along the transport assembly; the groups of computational elements being coupled to selected ones of said sensor units and said actuator units to define zones of control; each zone of control overlapping with other zones of control to coordinate transition of control between the computational elements as the object moves along the transport assembly.

2. The transport assembly according to claim 1, wherein said actuator units are spaced proximate to each other and ones of said sensor units on the transport assembly.

3. The transport assembly according to claim 1, wherein each of said computational elements is located proximate to one of said sensor units and one of said actuator units.

4. The transport assembly according to claim 1, wherein said computational elements further comprises:

a memory for storing computational instructions; and a processor coupled to memory for executing the computational instructions.

5. The transport assembly according to claim 1, wherein said computational elements shift control over the object between groups of computational elements with overlapping zones of control.

6. The transport assembly according to claim 1, wherein the arrangement of said multi-hierarchy of computational elements is modified to accommodate objects having different sizes.

7. The transport assembly according to claim 1, wherein each computational element in the first level of computational elements is coupled to two or more higher level computational elements.

8. The transport assembly according to claim 1, wherein the organization of said computational elements is homogeneous.

9. The transport assembly according to claim 1, wherein the organization of said computational elements is inhomogeneous.

10. The transport assembly according to claim 1, wherein said actuators comprise a plurality of air jet actuators.

11. The transport assembly according to claim 1, wherein one of the groups of computational elements is assigned dominant control over the object.

12. The transport assembly according to claim 11, wherein said computational elements shift dominant control over the object between groups of computational elements with overlapping zones of control.

13. The transport assembly according to claim 1, wherein said computational elements are organized into a first level of computational elements and a second level of computational elements.

14. The transport assembly according to claim 13, wherein each computational element in the first level of computational elements is directly coupled to at least one of said sensor units and at least one of said actuator units on the transport assembly.

15. The transport assembly according to claim 14, wherein each computational element in the second level of computational elements is indirectly or directly coupled to selected ones of the first level of computational elements.

16. The transport assembly according to claim 15, wherein said computational elements are organized into a third level of computational elements; each computational element in the third level of computational elements being directly coupled to computational elements in the first level of computational elements and directly or indirectly coupled to one or more computational elements in the second level of computational elements.

17. A method for controlling motion of an object on a transport assembly, the transport assembly having sensor units and actuator units arranged thereon, the sensor units providing positional information of the object and the actuator units moving the object relative to the transport assembly, said method comprising the steps of:

defining a plurality of computational elements for controlling motion of the object along the transport assembly;

arranging the plurality of computational elements multi-hierarchically into groups;

coupling selected ones of the sensor units and the actuator units to selected ones of the groups of computational elements to form overlapping zones of control; and coordinating transitions of control between the plurality of computational elements as the object moves along the transport assembly.

18. The method according to claim 17, further comprising the step of defining each zone of control with a sufficient number of the sensor units and actuator units to span the object on the transport assembly.

19. The method according to claim 17, wherein said coordinating step further comprises the steps of:

assigning a first group of computational elements dominant control over the object; and shifting dominant control to a second group of computational elements that has an overlapping zone of control with the first group of computational elements.

20. A transport assembly for moving paper, comprising:

sensor units arranged on the transport assembly for providing positional information of the paper;

actuator units arranged on the transport assembly for moving the paper relative to the transport assembly; and computational elements arranged multi-hierarchically into groups for controlling motion of the paper along the transport assembly; the groups of computational elements being coupled to selected ones of said sensor units and said actuator units to define zones of control; each zone of control overlapping with other zones of control to coordinate transition of control between the computational elements as the paper moves along the transport assembly.

* * * * *